United States Patent [19]

Bowerman et al.

[11] 4,212,120

[45] Jul. 15, 1980

[54] TRACK SHOES HAVING STRAIGHT LAST AND IMPROVED SPIKE PLACEMENT

[75] Inventors: William J. Bowerman; Geoffrey L. Hollister; Stanley L. James; Dennis E. Vixie, all of Eugene, Oreg.

[73] Assignee: BRS, Inc., Beaverton, Oreg.

[21] Appl. No.: 694,720

[22] Filed: Jun. 10, 1976

[51] Int. Cl.[2] ..... A43B 5/00

[52] U.S. Cl. ..... 36/129; 36/134

[58] Field of Search ..... 36/126, 128, 129, 134, 36/108, 83, 59 R, 67 D

[56] References Cited

U.S. PATENT DOCUMENTS

| | | | |
|---|---|---|---|
| 2,034,243 | 3/1936 | Maxwell | 36/108 |
| 2,572,680 | 10/1951 | Treat | 36/129 |
| 2,902,780 | 9/1959 | Bellew | 36/134 |
| 3,327,411 | 6/1967 | Roberts | 36/134 |
| 3,822,488 | 7/1974 | Johnson | 36/129 |
| 3,918,181 | 11/1975 | Inohara | 36/129 |

*Primary Examiner*—Patrick D. Lawson

*Attorney, Agent, or Firm*—Klarquist, Sparkman, Campbell, Leigh, Hall & Whinston

[57] ABSTRACT

A track shoe is described having a shoe upper and sole made on a straight last, whose last axis bisects the heel and passes through the second metatarsal head of the wearer's foot. The spike plate portion of the sole has a rear pair of spike fasteners which place the two rearmost spikes behind the heads of the overlying first and fifth metatarsal bones. The spike fasteners of such rear pair are centered along a straight line which intersects the last axis at an obtuse angle in the range of about 102° to 115° which is substantially the same as the angle of intersection between such axis and a line between the first and fifth metatarsal heads. A third spike fastener is located behind the head of the third metatarsal bone ahead of the line adjoining the rear pair of spike fasteners. The track shoe is provided with a shoe upper of open mesh nylon fabric.

6 Claims, 5 Drawing Figures

FIG. 1
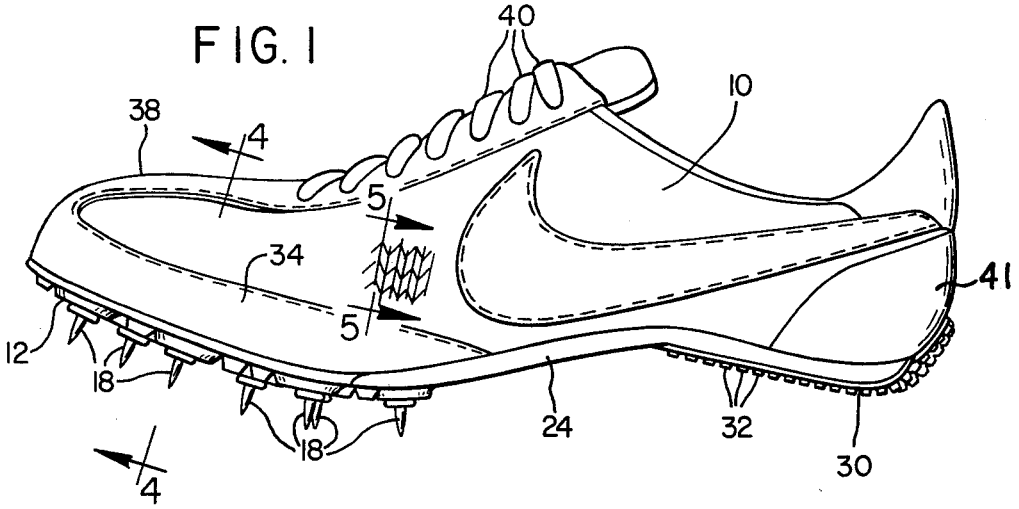
FIG. 2
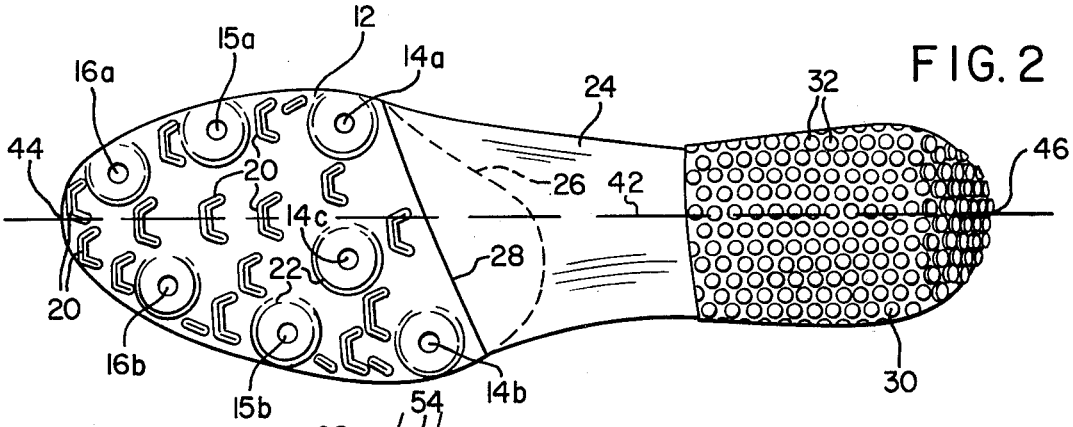
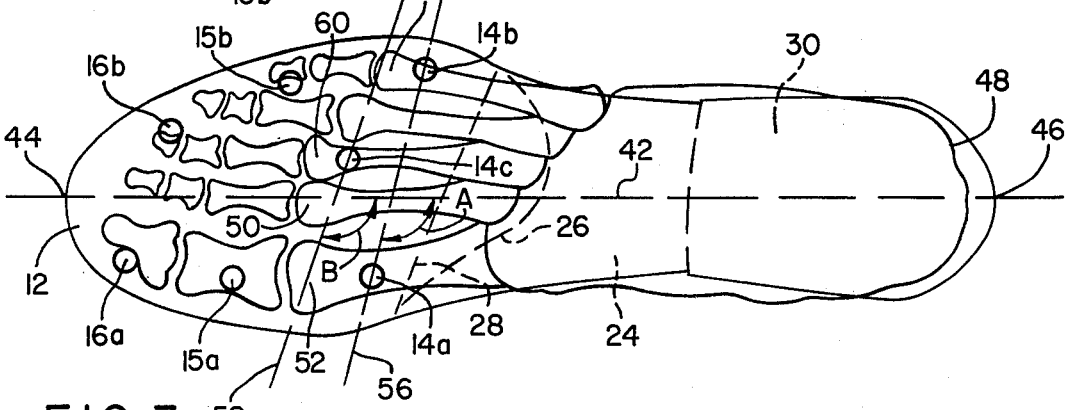
FIG. 3
FIG. 4
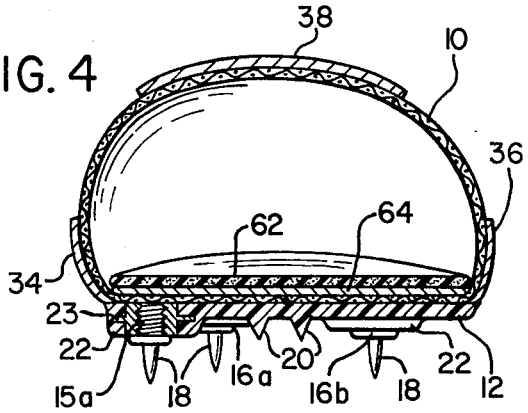
FIG. 5
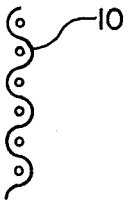

TRACK SHOES HAVING STRAIGHT LAST AND IMPROVED SPIKE PLACEMENT

BACKGROUND OF THE INVENTION

The subject matter of the present invention relates generally to spiked track shoes, and in particular, to such track shoes made on a straight last and having rear spikes positioned behind the heads of the overlying metatarsal bones of the wearer's foot.

The present track shoe is made on a straight last having a last axis which bisects the heel or calcaneous bone and extends through the second metatarsal head. This last axis corresponds to the natural weight bearing line or line of leverage of the foot as it pivots on the ankle or talus bone. As a result of this straight last and the improved spike placement, the track shoe of the present invention is more comfortable, reduces injury and provides greater running efficiency by giving more forward thrust for a given amount of force applied by the foot than previous track shoes. The track shoe of the present invention minimizes stress and deformation of the foot and thereby reduces injury.

Previously it has been proposed to make conventional street shoes on straight last, such as the shoe shown in U.S. Pat. No. 2,034,243 of Maxwell granted Mar. 17, 1936. However, this has not been done heretofore with spiked track shoes. Furthermore, the above-mentioned patent positions the last axis incorrectly relative to the wearer's foot, since such axis passes between the first and second metatarsal heads, rather than through the second metatarsal head in the manner of the present invention. While not critical for street shoes, the proper location of the last axis is extremely important for optimum performance of a track shoe. Previously, track shoes have positioned their rear spikes under the joints between the metatarsal and phalange bones, as shown in U.S. Pat. No. 2,902,780 of Bellew granted Sept. 8, 1959, as well as in other positions, including positions ahead of such joints or between such bones. This prior spike placement is inefficient because it has been found with the present invention that maximum forward thrust can only be achieved by locating the rear spikes behind the heads of the overlying metatarsal bones.

The track shoe of the present invention provides a pair of rear spikes behind the heads of the overlying first and fifth metatarsal bones and positions such rear spikes along a straight line which intersects the straight last axis at an obtuse angle greater than 102° and in the range of about 102° to 115°. As a result, such angle is substantially the same as the angle formed between the last axis and the line intersecting the metatarsal heads of the first and fifth metatarsal bones, although of course, this latter angle varies somewhat for different individual's feet. This enables the present shoe to bend more easily along the joints between the metatarsals and the phalanges where the foot flexes naturally, which is not possible with the spikes positioned under such joints as in U.S. Pat. No. 2,902,780. It has also been found that a third rear spike should be positioned behind the underlying third metatarsal head but ahead of the line connecting the rear-most pair of spikes. U.S. Pat. No. 3,327,411 of Roberts, granted June 27, 1967, is of interest because it discloses a football shoe having cleats, two of which are positioned behind the metatarsal heads but are followed by additional cleats including a longer cleat beneath the arch of the foot and three other cleats placed beneath the heel. This cleat arrangement is used to enable body weight to be transferred from the heel to the toe of the foot more efficiently which, of course, is not true in a track shoe since it has no spikes beneath the heel or arch areas of the foot.

SUMMARY OF THE INVENTION

One object of the present invention is to provide an improved spiked track shoe of greater comfort and running efficiency.

Another object of the invention is to provide such an improved track shoe which is made on a straight last having a last axis that bisects the heel and passes through the second metatarsal head of the wearer's foot to reduce the stresses applied to the foot by the shoe which tend to twist or deform the foot.

A further object of the present invention is to provide such a track shoe in which the rear-most pair of spikes are positioned behind the heads of the overlying metatarsal bones for greater efficiency of transfer of force from the foot to such spikes, resulting in greater forward thrust.

An additional object of the present invention provides such a track shoe in which the pair of rear spike fasteners have been positioned on a spike plate behind the first and fifth metatarsal heads along a straight line which intersects the last axis of such shoe at an obtuse angle substantially the same as the angle formed with such axis by a line adjoining the centers of the first and fifth metatarsal heads.

Still another object of the invention is to provide such a track shoe in which a third spike fastener is provided behind the head of the overlying third metatarsal and ahead of the line joining the rear pair of spike fasteners.

A still further object of the present invention is to provide such an improved track shoe which is lightweight, has a long useful lifetime and reduces injury to the wearer's foot and leg.

BRIEF DESCRIPTION OF DRAWINGS

Other objects and advantages of the present invention will be apparent from the following detailed description of a preferred embodiment thereof and from the attached drawings of which:

FIG. 1 is the side elevation view of the inner side of a track shoe in accordance with the present invention;

FIG. 2 is a plan view of the bottom of the track shoe of FIG. 1;

FIG. 3 is a diagrammatic top view of the shoe of FIGS. 1 and 2 with the shoe upper removed to show the relationship of the foot bones to the spike fasteners and last axis of the shoe;

FIG. 4 is an enlarged vertical section view taken along the line 4—4 of FIG. 1; and FIG. 5 is an enlarged vertical section view taken along line 5—5 of FIG. 1.

DESCRIPTION OF PREFERRED EMBODIMENT

As shown in FIGS. 1 and 2, the track shoe of the present invention includes a shoe upper 10 of leather or synthetic plastic fabric. The upper 10 is preferably a nylon fabric which may be an open mesh fabric woven in a single layer, as shown in FIG. 5. A spike plate 12 of solid molded synthetic plastic material, such as nylon, is bonded to the bottom of the upper material 10 in position beneath the toes and metatarsal bones of the foot. The spike plate is provided with seven spike fasteners, including rear fasteners 14*a*, 14*b* and 14*c*, intermediate fasteners 15*a* and 15*b* and front fasteners 16*a* and 16*b*. The spike fasteners are provided with internally threaded sockets for receipt of the threaded ends of metal pins or spikes 18. A plurality of C-shaped projections 20 are molded into the bottom surface of the spike plate 12 of nylon material. Projections 20 extend downward from the flat surface of the spike plate, a distance equal to or greater than molded annular mounds 22 surrounding and covering the spike fasteners. The spike fasteners each have an external flange 23 midway between its opposite ends to anchor such fasteners in mounds 22.

As shown in FIG. 2, all of the projections 20 inside the ring of spike fasteners 14*a*, 15*a*, 16*a*, 16*b*, 15*b* and 14*b*, are formed slightly longer than the mounds 22, while the remaining projections are of substantially the same height of such mounds. These C-shaped molded plastic projections 22 open rearwardly and engage the surface of an all-weather track, which is typically made of rubberized asphalt, to provide additional traction.

As shown in FIGS. 1 and 2, a cushioning sole layer of resilient synthetic plastic foam 24 is provided over the remaining bottom surface of the shoe upper, including the arch and heel portions of such shoe, for cushioning and heel lift. The foam layer 24 is bonded over the top of a thin tab portion 26 of the spike plate which extends rearwardly from the end 28 of the main portion of the spike plate behind the rearmost pair of spike fasteners 14*a* and 14*b*. A rubber heel covering layer 30, having a plurality of small annular bumps 32, is provided over the outer surface of the heel portion of the foam sole layer 24 to prevent such foam sole layer from wearing and to provide additional traction.

As shown in FIGS. 1 and 2, the nylon fabric upper 10 may be provided with leather reinforcing portions 34 and 36 on opposite sides of the front portion of the upper extending from the spike plate upward approximately one-third the height of such upper. An additional leather reinforcing member 38 formed integrally with members 34 and 36 extends upward to provide lace reinforcing strips through which lace holes are provided for shoelace 40 to secure the shoe on the wearer's foot in a conventional manner. Other leather reinforcing 41 can be employed over the heel of the upper to provide a stronger heel counter.

As shown in FIGS. 2 and 3, the track shoe of the present invention is made on a straight last having a last axis 42 which, in most cases, extends between the forward most point 44 of the shoe sole to the rearward most point 46 of such sole. The last axis 42 of the shoe is designed to extend along a straight line which bisects the heel bone or calcaneus 48 and passes through the second metatarsal head 50 of the wearer's foot. This last axis 42 corresponds to the weight bearing line of the foot and the line of leverage through which the foot pivots on the ankle bone or talus. It has been found that by providing a straight last track shoe with a last axis 42, which extends through the second metatarsal head and along the second metatarsal bone of the wearer's foot, such foot is not distorted or twisted by the shoe during running and injuries are reduced.

For maximum forward thrust it has been found that the rear part of spiked fasteners 14*a* and 14*b* should be positioned behind the first metatarsal head 52 and the fifth metatarsal head 54, respectively. Also, a straight line 56 joining the centers of the rear pair of fasteners 14*a* and 14*b*, hereafter called the "rear spike pair line", should extend at an obtuse angle A to the last axis 42 in the range of about 102° and 115°, such angle being preferably about 107° to 110°. This angle A is measured between the forward most portion of line 56 closest to the inside of the shoe and extending backward to the last axis 42. This rear spike pair line 56 forms substantially the same angle as the angle B between the last axis 42 and a straight line 58 extending through the first metatarsal head 52 and the fifth metatarsal head 54 which is typically about 108°. Of course, angle B is not always 108° but varies slightly with different individual's feet and this accounts in part for the range of angles specified for angle A.

In addition, the third rear spike fastener 14*c* is positioned behind the third metatarsal head 60 but is positioned in front of the rear spike pair line 56, since the third metatarsal head normally lies in front of the line 58 between the first and fifth metatarsal head. It should be noted that the third rear spike fastener 14*c* is not always aligned with the line 58; also the rear spike fasteners 14*a*, 14*b* and 14*c* can be positioned under or slightly behind the metatarsal heads.

By arranging the rear pair of spiked fasteners 14*a* and 14*b* along line 56 under or behind the first and fifth metatarsal heads, the rearward force exerted by such metatarsal heads during running is most efficiently transferred to the spikes in such fasteners. Also, unlike U.S. Pat. No. 2,902,780 referred to above, the line of flex of the foot at the joints between the metatarsal heads and the phalanges is unrestricted by spikes. This insures more efficient transfer of body weight from the foot to the spikes and greater forward thrust.

The two front spike fasteners 16*a* and 16*b* are provided on the spike plate 12 respectively positioned over the first toe distal phalanx and the third toe distal phalanx, while the two intermediate spike fasteners 15*a* and 15*b* are provided respectively over the first toe proximal phalanx and the fifth toe distal phalanx, of the wearer's foot. This distribution of seven spikes more uniformly distributes the weight of the runner and provides more efficient weight transfer without interferring with the natural flexing of the foot.

As shown in FIG. 4, the interior of the shoe upper 10 contains a thin cushioning insole layer 62 of resilient plastic foam material such as closed cell polyurethane foam provided with a fabric layer on its upper surface to prevent blistering. This insole layer 62 is glued on the upper surface of a hard platform layer 64 of fiberboard or other suitable material bonded to the upper 10 and covering the spike plate to prevent the foot from feeling the heads of the spike fasteners.

It will be obvious to those having ordinary skill in the art that many changes may be made in the details of the above-described preferred embodiment of the present invention without departing from the spirit of the invention. For example, other types of shoe upper material can be employed, including leather or a three-layer upper of nylon fabric, open cell polyurethane foam and tricote fabric, as well as a combination of leather and such multi-layered fabric as described in U.S. Pat. No. 3,822,488 of Johnson granted July 9, 1974. Therefore, the scope of the present invention shall only be determined by the following claims.

I claim:

1. A track shoe comprising:

a shoe upper;

a spike plate attached to said shoe upper and having a plurality of spike fasteners secured thereto which are adapted to hold track spike elements;

said fasteners including a rear pair of first and second rear spike fasteners located at positions that will be beneath the overlying metatarsal bones of the wearer's foot and behind the heads of said metatarsal bones, said rear spike fasteners being centered on a straight line which slants backward from the inside to the outside of said shoe; and said fasteners including a third rear spike fastener located at a position that will be behind the head of the overlying metatarsal bone of the wearer's foot between said rear pair of spike fasteners and ahead of said line joining the centers of said rear pair of fasteners.

2. A track shoe in accordance with claim 1 in which the position of the third fastener will be under the third metatarsal and positions of the first and second fasteners will be under the first and fifth metatarsals, respectively, of the wearer's foot.

3. A track shoe comprising:

a shoe upper being formed on a straight last with a longitudinal last axis that will substantially bisect the calcaneous and pass through the head of the second metatarsal bone of the wearer's foot; and a spike plate attached to said shoe upper and having a plurality of spike fasteners secured thereto which are adapted to hold track spike elements, said fasteners including a rear pair of first and second rear spike fasteners located at positions that will be behind the heads of the overlying metatarsal bones of the wearer's foot and centered on a straight line which slants backward from the inside to the outside of said shoe; and a third rear spike fastener located at a position that will be behind the head of the overlying metatarsal bone of the wearer's foot between said rear pair of spike fasteners and ahead of said line joining the centers of said rear pair of fasteners.

4. A track shoe in accordance with claim 1 in which the position of the third fastener will be under the third metatarsal and positions of the first and second fasteners will be under the first and fifth metatarsals, respectively, of the wearer's foot.

5. A track shoe in accordance with claim 4 which also includes a front pair of spike fasteners on said spike plate which are positioned under the first and third distal phalanges of the wearer's foot.

6. A track shoe in accordance with claim 5 which also includes an intermediate pair of spike fasteners on said spike plate which are positioned between said front pair and said rear pair of fasteners.

* * * * *

UNITED STATES PATENT AND TRADEMARK OFFICE

CERTIFICATE OF CORRECTION

PATENT NO. : 4,212,120

DATED : July 15, 1980

INVENTOR(S) : William J. Bowerman et al.

It is certified that error appears in the above—identified patent and that said Letters Patent is hereby corrected as shown below:

Column 3, line 64, "part" should read -- pair --.

Column 6, line 15, claim 4, "1" should read -- 3 --.

Signed and Sealed this

Ninth Day of June 1981

[SEAL]

Attest:

RENE D. TEGTMEYER

Attesting Officer

Acting Commissioner of Patents and Trademarks